US008531277B2

(12) United States Patent
Graham

(10) Patent No.: US 8,531,277 B2
(45) **Date of Patent: *Sep. 10, 2013**

(54) FINDING SYSTEM

(76) Inventor: Tarah N. Graham, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/114,036

(22) Filed: May 23, 2011

(65) Prior Publication Data

US 2012/0274465 A1 Nov. 1, 2012

Related U.S. Application Data

(63) Continuation of application No. 11/786,801, filed on Apr. 11, 2007, now Pat. No. Re. 42,613, which is an application for the reissue of Pat. No. 6,879,254.

(51) Int. Cl.
*G08B 3/10* (2006.01)

(52) U.S. Cl.
USPC ..... 340/384.3

(58) Field of Classification Search
USPC ..... 340/539.32, 539.13, 568.1, 815.42, 340/815.43, 815.4; 341/20, 22, 176; 455/575.1, 567; 398/106
See application file for complete search history.

(56) References Cited

U.S. PATENT DOCUMENTS

| | | | | |
|---|---|---|---|---|
| 5,790,021 | A * | 8/1998 | Mickel et al. | 340/539.32 |
| 5,952,918 | A * | 9/1999 | Ohayon | 340/539.32 |
| 6,308,074 | B1 * | 10/2001 | Chandra et al. | 455/462 |
| 6,360,399 | B1 * | 3/2002 | Vandenbelt et al. | 15/324 |
| 6,366,202 | B1 * | 4/2002 | Rosenthal | 340/539.32 |
| 6,445,290 | B1 * | 9/2002 | Fingal et al. | 340/539.32 |
| 6,489,746 | B1 * | 12/2002 | Pettinato | 320/111 |
| 6,535,125 | B2 * | 3/2003 | Trivett | 340/539.13 |

* cited by examiner

*Primary Examiner* — Phung Nguyen
(74) *Attorney, Agent, or Firm* — Minh N. Nguyen, Esq.; Next IP Law Group LLP

(57) ABSTRACT

A finding system with a base charger, finder, and other functional features includes a receiving unit and a base unit. The receiving unit is recharged using the base unit. The base unit also includes a button operationally coupled to a transmitter for sending a locate signal to the receiving unit. The receiving unit includes a receiver for receiving the locate signal. In response to the locate signal, the receiving unit provides audio and visual signals to assist a user in finding the receiving unit. The receiving unit can include, but is not limited to, a remote control unit that has the capability to operate multiple devices including TVs, VCRs, satellite receivers, audio and visual receivers, stereo equipment, and the like.

20 Claims, 5 Drawing Sheets

REMOTE CONTROL

CHARGER BASE

FINDING SYSTEM

CROSS REFERENCE TO RELATED APPLICATIONS

This application is a continuation of U.S. utility application entitled, "Rechargeable universal remote control assembly," having Ser. No. 11/786,801 and original filing date of Nov. 15, 2002, and issued as U.S. Pat. No. RE42613, "Rechargeable universal remote control assembly," having Ser. No. 10/295,627, filed on Nov. 15, 2002 and issued as U.S. Pat. No. 6,879,254, all of which are entirely incorporated herein by reference.

BACKGROUND

The use of universal remote controls is known in the prior art. U.S. Pat. No. 4,718,112 describes a remote control apparatus for programming a series of control commands for use at a later time. Another type of universal remote controls is U.S. Pat. No. 5,953,144 having a ROM-less microprocessor system. U.S. Pat. No. 5,790,021 discloses a remote control having a base unit and a remote control finder. U.S. Pat. No. 3,582,783 discloses a multiple function remote control unit. U.S. Pat. No. 5,412,377 also discloses a remote control unit that has a scheduling function. U.S. Pat. No. Des. 435,544 shows an ornamental design for a universal remote control.

While these devices fulfill their respective, particular objectives and requirements, the need remains for a remote control system that will provide commands for multiple and various devices in combination with a base unit for recharging the remote control, a remote control finding function, and wherein the remote control has a light for outlining the housing of the remote control.

SUMMARY BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION

Figure 1:
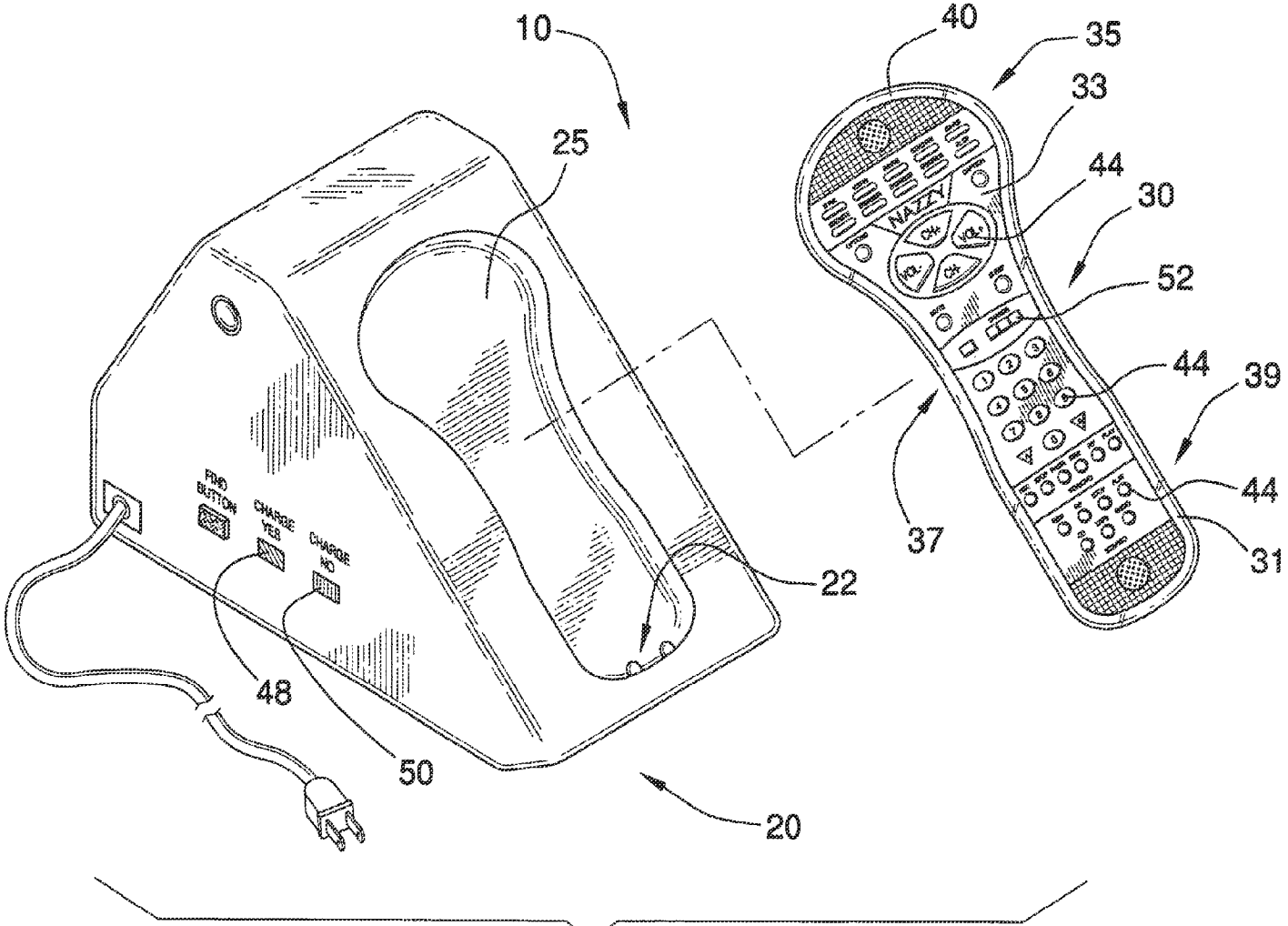
FIG. 1 is a perspective view of a new rechargeable universal remote control assembly according to the present invention.
Figure 2:
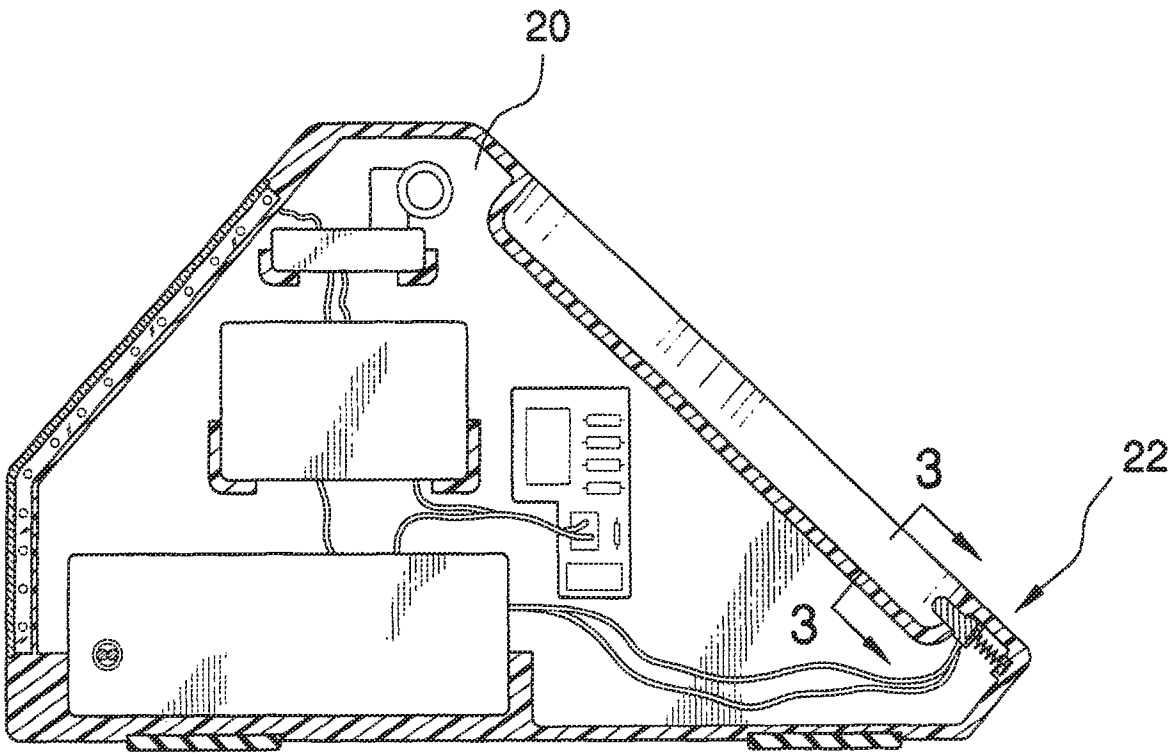
FIG. 2 is a cross-sectional view of the base unit of the present invention.
Figure 3:
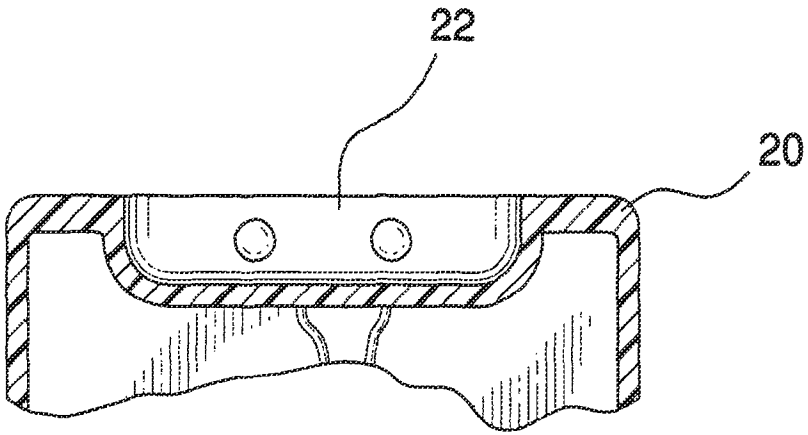
FIG. 3 is a cross-sectional view of the base unit of the present invention taken along line 3-3 in FIG. 2.
Figure 4:
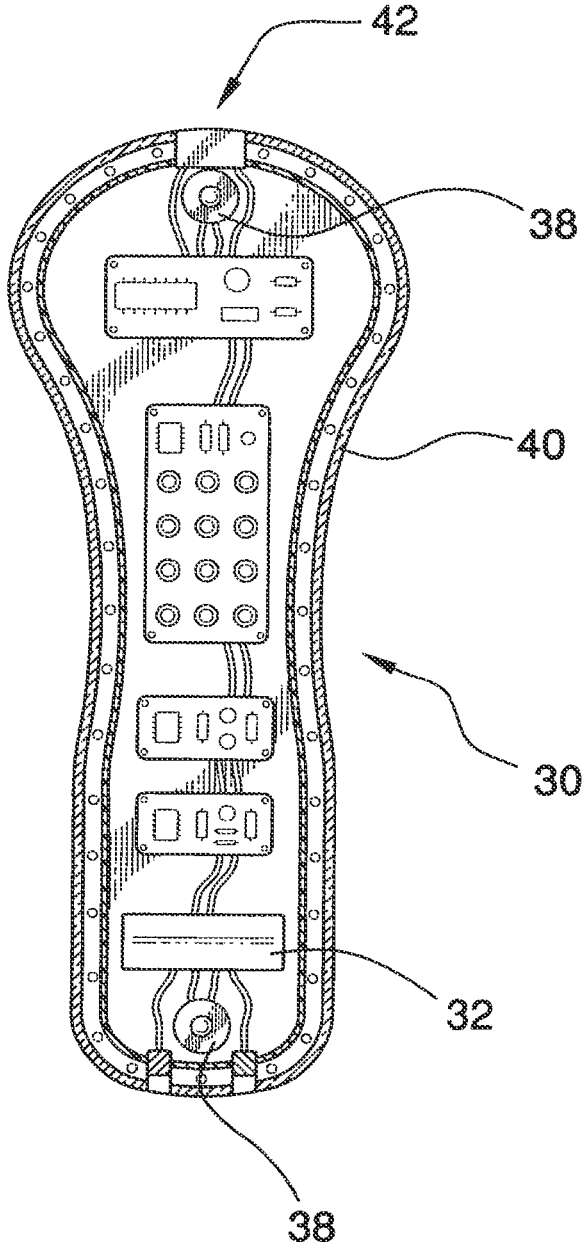
FIG. 4 is a cross-sectional view of the remote unit of the present invention.
Figure 6:
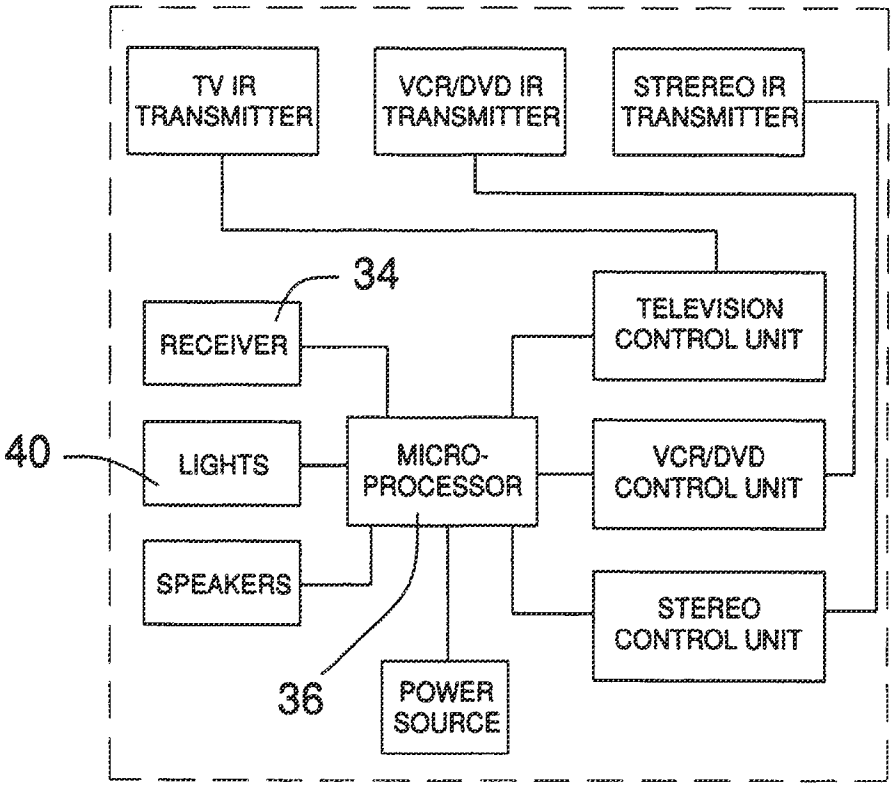
FIG. 6 is a schematic diagram view of the remote unit of the present invention.
Figure 5:
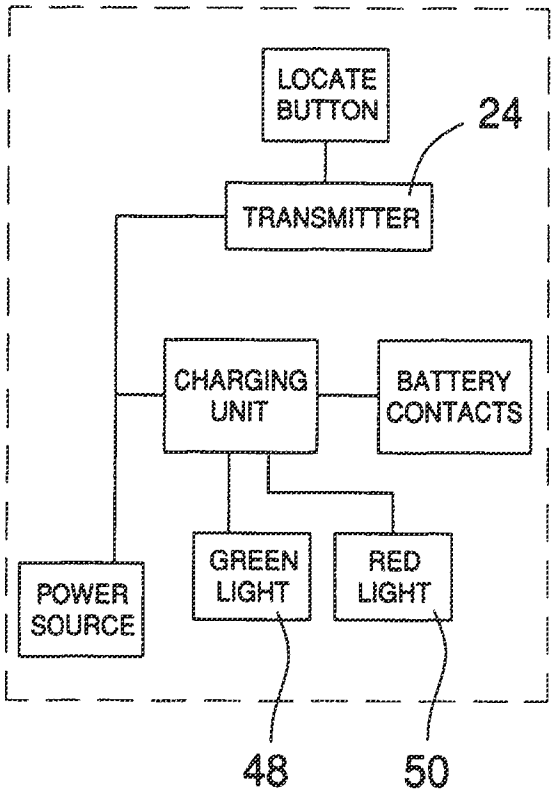
FIG. 5 is a schematic diagram view of the base unit of the present invention.

With reference now to the drawings, and in particular to FIGS. 1 through 6 thereof, a new rechargeable universal remote control assembly embodying the principles and concepts of the present invention and generally designated by the reference numeral 10 will be described.

As best illustrated in FIGS. 1 through 6, the rechargeable universal remote control assembly 10 generally comprises a base unit 20 having a charging port 22 and a remote control unit 30 having a battery 32. The remote control unit 30 is positionable on the base unit 20 such that the remote control unit 30 operationally engages the charging port 22. Thus, the base unit 20 charges the battery 32 of the remote control unit 30.

A transmitter 24 is positioned in the base unit 20 for transmitting a locate signal. A receiver 34 is positioned in the remote control unit 30 for receiving the locate signal from the transmitter 24.

A microprocessor 36 is positioned in the remote control unit 30. The receiver 34 is operationally coupled to the microprocessor 36. A speaker 38 is operationally coupled to the microprocessor 36 for producing an audio signal from the remote control unit 30 when the receiver 34 receives the locate signal from the transmitter 24.

A light source 40 is operationally coupled to the microprocessor 36 for illuminating when the receiver 34 receives the locate signal from the transmitter 24. The light source 40 is a tubular light extending around a perimeter 31 of the remote control unit 30.

An infrared transmitter 42 is operationally coupled to the microprocessor 36 for sending operational commands from the remote control unit 30 based on use of a plurality of operational keys 44. Each of the operational keys 44 is operationally coupled to the microprocessor 36 for sending a selectable operational command from the remote control unit 30 using the operational keys 44. The operational keys are configured into groups for controlling particular devices including TV, VCR, DVD, stereo and video receivers, satellite receivers, and audio equipment. The remote control unit may further include operational keys and programs to operate other household devices such as ceiling fans or appliances remotely using the remote control unit 30.

A plurality of indicator lights 46 are positioned on the base unit 20. One of the indicator lights is a positive charging light 48. The positive charging light 48 illuminates when the remote control unit 30 engages the charging port 22 of the base unit 20 to successfully charge the battery 32 of the remote control unit 30. A second one of the indicator lights is a negative charging light 50. The negative charging light 50 illuminates when the remote control unit 30 is disengaged from the charging port 22 of the base unit 20.

The remote control unit 30 has a plurality of battery charge indicators 52 operationally coupled to the battery 32 for indicating a charge level of the battery 32. In an embodiment, the battery charge indicators 52 are aligned next to each other and illuminate in sequence such that a number of illuminated battery charge indicators indicates a degree to which the battery 32 is charged.

The remote control unit 30 has a housing 33 having a bulbous forward portion 35, a neck portion 37, and a rear portion 39. The base unit 20 has a depression 25 for receiving the remote control unit 30. The depression 25 has a complementary shape to the remote control unit 30 to prevent movement of the remote control unit 30 within the depression 25.

In use, the remote control unit is placed into the depression of the base unit to charge the remote control unit. The remote control unit is used in similar fashion to existing remote controls to operate a variety of devices. When removed from the base unit, the remote control unit can be located easily by pressing a button on the base unit. In response to the button on the base unit being pressed, the remote control unit provides an audio signal via a speaker and a visual signal via the light source extending around the perimeter of the remote control unit.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A finding system comprising:

a base unit having a charging port;

a receiving unit having a battery, said receiving unit being positionable on said base unit such that said receiving unit operationally engages said charging port whereby said base unit charges said battery of said receiving unit;

a transmitter positioned in said base unit for transmitting a locate signal;

a receiver positioned in said receiving unit for receiving said locate signal from said transmitter;

a microprocessor positioned in said receiving unit, said receiver being operationally coupled to said microprocessor;

a speaker operationally coupled to said microprocessor for producing an audio signal from said receiving unit when said receiver receives said locate signal from said transmitter;

a light source operationally coupled to said microprocessor for illuminating when said receiver receives said locate signal from said transmitter; and wherein said light source is a tubular light extending around a perimeter of said remote control unit to illuminate an area around said receiving unit.

2. The finding system of claim 1, further comprising:

an infrared transmitter operationally coupled to said microprocessor for sending operational commands from said receiving unit.

3. The finding system of claim 1, further comprising:

a plurality of indicator lights on said base unit, one of said plurality of indicator lights being a positive charging light, said charging light illuminating when said receiving unit engages said charging port of said base unit to successfully charge said battery of said receiving unit.

4. The finding system of claim 3 wherein a second one of said plurality of indicator lights is a negative charging light, said negative charging light illuminating when said receiving unit is disengaged from said charging port of said base unit.

5. The finding system of claim 1, further comprising:

said receiving unit including a plurality of operational keys, each of said operational keys being operationally coupled to said microprocessor for sending a selectable operational command from said receiving unit using said operational keys.

6. The finding system of claim 1, further comprising:

said receiving unit having a plurality of battery charge indicators operationally coupled to said battery for indicating a charge level of said battery.

7. The finding system of claim 6, further comprising:

said plurality of battery charge indicators being aligned next to each other and illuminating in sequence such that a number of illuminated battery charge indicators indicates a degree to which said battery is charged.

8. The finding system of claim 1, further comprising:

said receiving unit having a housing, said housing having a bulbous forward portion, a neck portion, and a rear portion; and said base unit having a depression for receiving said receiving unit, said depression having a complementary shape to said receiving unit to prevent movement of said receiving unit within said depression and to insure proper alignment of said receiving unit in said depression of said base unit for proper charging of said battery of said receiving unit.

9. A finding system comprising:

a base unit having a charging port;

a receiving unit having a battery, said receiving unit being positionable on said base unit such that said receiving unit operationally engages said charging port whereby said base unit charges said battery of said receiving unit;

a transmitter positioned in said base unit for transmitting a locate signal;

a receiver positioned in said receiving unit for receiving said locate signal from said transmitter;

a microprocessor positioned in said receiving unit, said receiver being operationally coupled to said microprocessor;

a speaker operationally coupled to said microprocessor for producing an audio signal from said receiving unit when said receiver receives said locate signal from said transmitter;

a light source operationally coupled to said microprocessor for illuminating when said receiver receives said locate signal from said transmitter;

wherein said light source is a tubular light extending around a perimeter of said receiving unit;

an infrared transmitter operationally coupled to said microprocessor for sending operational commands from said receiving unit;

a plurality of indicator lights on said base unit, one of said plurality of indicator lights being a positive charging light, said charging light illuminating when said receiving unit engages said charging port of said base unit to successfully charge said battery of said receiving unit;

wherein a second one of said plurality of indicator lights is a negative charging light, said negative charging light illuminating when said receiving unit is disengaged from said charging port of said base unit;

said receiving unit including a plurality of operational keys, each of said operational keys being operationally coupled to said microprocessor for sending a selectable operational command from said receiving unit using said operational keys;

said receiving unit having a plurality of battery charge indicators operationally coupled to said battery for indicating a charge level of said battery;

said plurality of battery charge indicators being aligned next to each other and illuminating in sequence such that a number of illuminated battery charge indicators indicates a degree to which said battery is charged;

said receiving unit having a housing, said housing having a bulbous forward portion, a neck portion, and a rear portion; and said base unit having a depression for receiving said receiving unit, said depression having a complementary shape to said receiving unit to prevent of said receiving unit within said depression.

10. A finding system comprising:

a base unit having a charging port;

a receiving unit having a battery, the receiving unit being positionable on the base unit such that said receiving unit operationally engages the charging port whereby the base unit charges the battery of the receiving unit;

a transmitter positioned in the base unit for transmitting a locate signal;

a receiver positioned in the receiving unit for receiving the locate signal from the transmitter; and a light source positioned in the receiving unit for producing a findable visual signal to assist a user in finding the receiving unit when the receiver receives the locate signal from the transmitter, the light source being distributed over the remote control unit so as to make the visual signal less likely to be obscured.

11. The finding system of claim 10, further comprising a speaker for producing a findable audio signal to assist a user in finding the receiving unit when the receiver receives the locate signal from the transmitter.

12. The finding system of claim 10, wherein the light source extends around at least a portion of a perimeter of the receiving unit.

13. The finding system of claim 10, wherein the light source is a tubular light.

14. The finding system of claim 10, wherein the receiving unit is a remote control.

15. The finding system of claim 10, wherein a microprocessor is positioned in the receiving unit and the receiver is operationally coupled to the microprocessor.

16. The finding system of claim 15, wherein an infrared transmitter is positioned in the receiving unit and is operationally coupled to the microprocessor for sending operational commands from the receiving unit.

17. The finding system of claim 10, wherein the base unit includes at least one charging indicator light for indicating the charging status of the receiving unit.

18. The finding system of claim 17, wherein the at least one charging indicator light included in the base unit is a positive charging light, the positive charging light illuminating when the receiving unit engages the charging port of the base unit to successfully charge the battery of the receiving unit.

19. The finding system of claim 17, wherein the at least one charging indicator light included in the base unit is a negative charging light, the negative charging light illuminating when the receiving unit is disengaged from the charging port of the base unit.

20. The finding system of claim 10, wherein the light source is distributed over the receiving unit so as to be substantially situated at least at two corners of the receiving unit.

* * * * *